United States Patent [19]

Hedgewick

[11] Patent Number: 5,002,424

[45] Date of Patent: Mar. 26, 1991

[54] REFLECTIVE PAVEMENT MARKER WITH INCLINED REINFORCING RIBS

[75] Inventor: Peter Hedgewick, Windsor, Canada

[73] Assignee: Pac-Tec, Inc., Newark, Ohio

[21] Appl. No.: 470,117

[22] Filed: Jan. 24, 1990

[51] Int. Cl.[5] ..... G08B 5/00

[52] U.S. Cl. ..... 404/14; 404/13; 404/11; 350/109; 350/100; 350/103

[58] Field of Search ..... 404/13, 14, 11, 12; 350/100, 103, 109; D10/113

[56] References Cited

U.S. PATENT DOCUMENTS

| | | | |
|---|---|---|---|
| 3,332,327 | 7/1967 | Heenan | 404/16 |
| 3,409,344 | 11/1968 | Balint et al. | 404/14 |
| 3,971,623 | 7/1976 | Hedgewick et al. | 404/12 |
| 3,980,410 | 9/1976 | Suhr et al. | 404/16 |
| 3,984,175 | 10/1976 | Suhr et al. | 350/109 |
| 4,070,095 | 1/1978 | Suhr | 404/12 |
| 4,428,320 | 1/1984 | Oplt et al. | 404/14 |
| 4,498,733 | 2/1985 | Flanagan | 404/14 |

*Primary Examiner*—Ramon S. Britts
*Assistant Examiner*—Roger J. Schoeppel
*Attorney, Agent, or Firm*—Gifford, Groh, Sprinkle, Patmore and Anderson

[57] ABSTRACT

A reflective pavement marker of the type having a shell-like housing of synthetic resin or other moldable material with reflective end walls of light transmitting material and a filler of epoxy or other potting material. Ribbing is formed on the inner surface of the housing. The ribbing has a surface that makes an acute angle with respect to the inner surface of the housing to coact with the filler material to increase the resistance to separation of the filler material from the housing.

10 Claims, 2 Drawing Sheets

REFLECTIVE PAVEMENT MARKER WITH INCLINED REINFORCING RIBS

TECHNICAL FIELD

This invention relates generally to reflective pavement markers and is particularly concerned with pavement markers of the type having a shell-like housing with a reflective portion of light transmitting material, and which is filled with a potting material, such as epoxy resin.

BACKGROUND OF THE INVENTION

Heenan U.S. Pat. No. 3,332,327 ('327), Balint U.S. Pat. No. 3,409,344 (344) and Suhr U.S. Pat. No. 3,984,175 (175) each disclose a reflective pavement marker having a shell-like housing of synthetic resin with a reflective portion of light transmitting material formed with retro-directive reflector elements of the cube corner type. The housing is filled with an epoxy resin to give the pavement marker impact strength. One of the problems associated with this type of pavement marker is that of maintaining a secure adhesive bond between the filler material and the inner surface of the housing. If the filler (sometimes referred to as "potting material") separates from the inner surface of the housing, the housing will be vulnerable to cracking under the impact forces of vehicle wheels. This problem was addressed in the Balint 344 patent with the formation of interlocking ribs 57 projecting at right angles from the inner surface of the housing. The same problem was also addressed in the Suhr 175 parent by the provision of a plurality of projections 22 on the inner surface of the housing.

DISCLOSURE OF THE INVENTION

A reflective pavement marker according to the present invention includes a shell-like housing having a top wall, a pair of depending side walls, and a reflective end wall depending from one end of the top wall and extending transversely between the side walls. Ribbing is formed integrally on the inner surface of the housing. The ribbing projects from the inner surface of the housing and has at least one lengthwise surface that makes an acute angle with respect to the inner surface of the housing. When the housing is filled with potting material, such as an epoxy filler disclosed in the Balint 344 and Suhr 175 patents, the ribbing is embedded therein. The lengthwise surface of the ribbing that makes an acute angle with respect to the inner surface of the housing has a wedging relationship with the potting material to resist its separation from the housing surface.

The pavement marker can be manufactured efficiently by molding the housing in two halves which are then joined together and filled with the potting material. Each of the housing halves comprises an integral shell-like housing component including a top wall, a pair of side walls depending from opposite sides of the top wall, along the full length thereof, with each of the side walls having a triangular portion that projects from one end of the top wall and has an inclined edge that makes an acute angle with the top wall. The reflective end wall of the housing component is joined to the inclined edges of the side walls and the adjacent end of the top wall. The reflective end wall has a substantially planar outer surface and an inner surface formed with reflective elements.

The ribbing is formed integrally on the inner surface of the housing component and has a lengthwise surface that makes an acute angle with respect to the inner surface and a right angle with respect to the outer surface of the reflective end wall. The right angle relationship of the ribbing surface with the outer surface of the reflective end wall makes it possible to mold the end wall as a unit with the housing component and to eject the housing component from the mold in a direction parallel to the ribbing.

In addition to the ribbing, the housing components are formed with a plurality of cylindrical studs that project integrally from the inner surface of the housing component and which also have an axis that makes an acute angle with respect to the inner housing surface, and which is parallel to the ribbing surface. The angular disposition of the studs also inhibits separation of the potting material from the inner surface of the housing, and facilitates the manufacture of the housing components During the injection molding process ejector pins of the molding apparatus engage the studs to eject the housing component from the molding apparatus.

DESCRIPTION OF THE BEST MODE OF CARRYING OUT THE INVENTION

Figure 1:
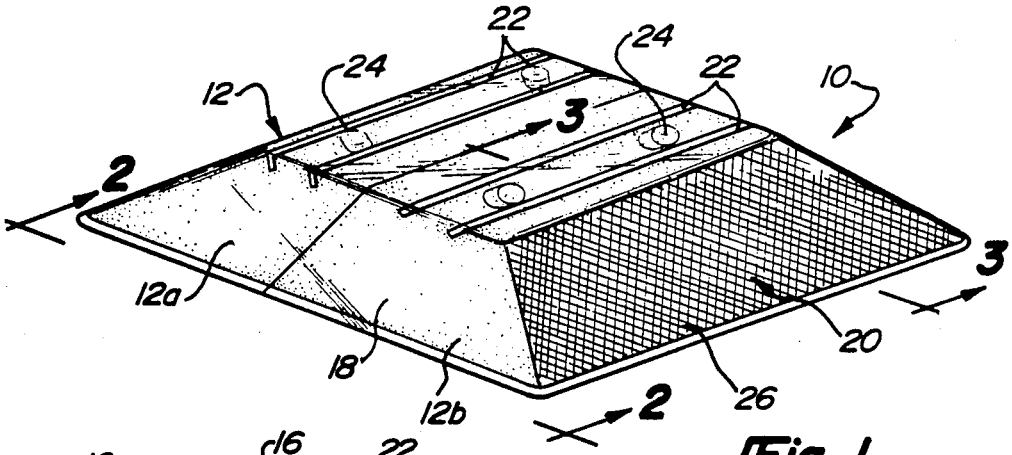
FIG. 1 is a perspective view of one preferred form of a reflective pavement marker according to the invention.

In FIGS. 1-4, reference numeral 10 collectively designates a reflective pavement marker that includes a shell-like housing 12 filled with potting material such as an epoxy resin as disclosed, for example, in the Heenan '327, Balint '344 and Suhr '175 patents. The housing 12 is made up of two components 12A and 12B which may be molded separately from each other.

Figure 2:
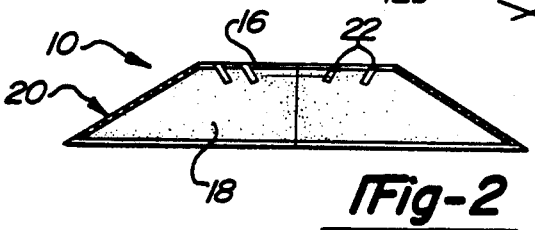
FIG. 2 is a view in the direction of lines 2—2 of FIG. 1 which is reduced in scale with respect to FIG. 1.
Figure 3:
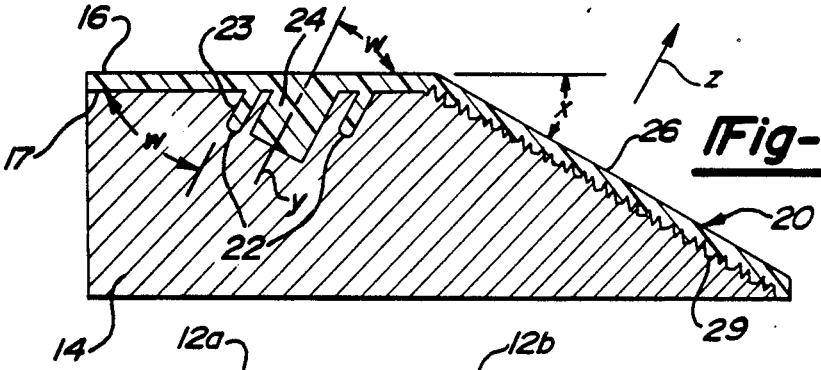
FIG. 3 is a partial sectional view taken along lines 3—3 of FIG. 1.
Figure 4:
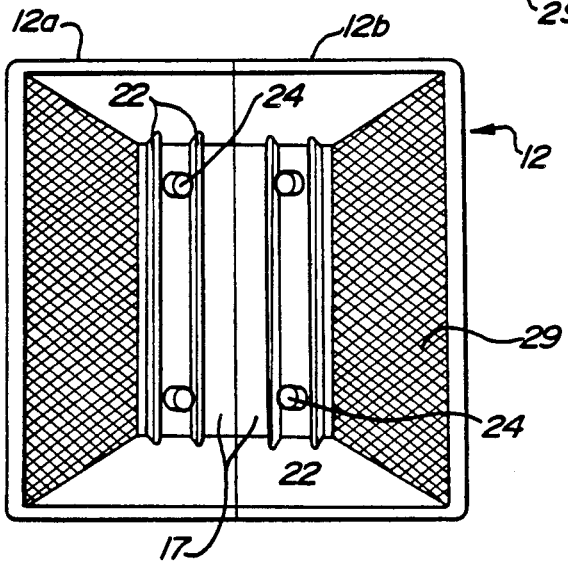
FIG. 4 is a bottom view of the housing of the pavement marker of FIG. 1.
Figure 5:
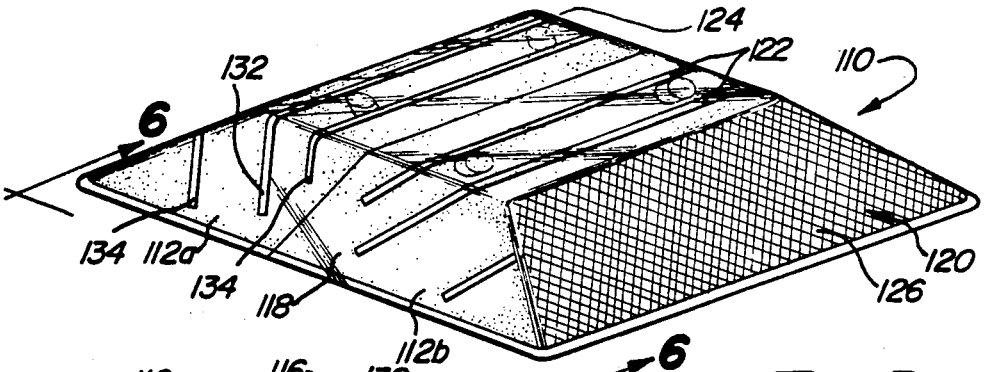
FIG. 5 is a perspective view of a second embodiment of a reflective pavement marker according to the present invention.
Figure 6:
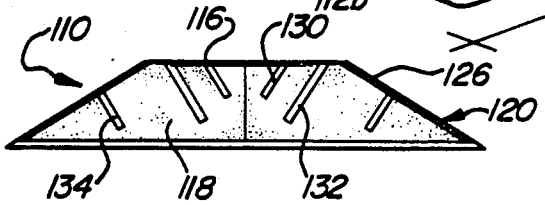
FIG. 6 is a view similar to FIG. 2 is the direction of lines 6—6 of FIG. 5.
Figure 7:
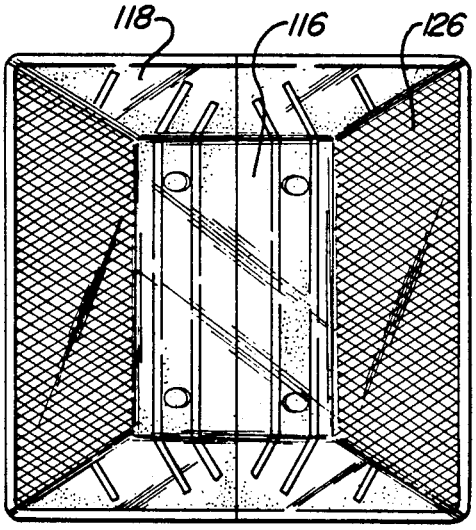
FIG. 7 is a top plan view of the pavement marker of FIG. 5.

The housing 12 has a top wall 16, side walls 18, and reflective end walls 20 that each depend from one end of the top wall 16 and extend transversely between the side walls 18. In accordance with this invention, ribbing projects from the inner surface of the housing. In the illustrated embodiment of FIGS. 1-4, the ribbing consists of four top wall ribs 22. Each rib 22 projects integrally from the inner surface of the top wall and extends lengthwise between the side walls with its opposite ends joined integrally to respective ones of the side walls 18 at the junction of the side walls with the top wall. In the illustrated embodiments of FIGS. 1-4, housing 12 is made of light transmitting material, in its entirety, and the ribs 22 are each externally visible as shown in FIGS. 1 and 2 Each rib 22 has a lengthwise surface 23 that makes an acute angle w with respect to the inner surface 17 of the top wall (FIG. 3).

The reflective end wall 20 has an outer, substantially planar surface 26 and an inner surface on which is formed reflective elements 29. The illustrate reflective elements 29 are of the cube corner type disclosed in the prior art Heenan 327, Balint 344 and Suhr 175 patents. However, the invention is not limited to any specific type of reflecting system. Reflective elements other than the cube corner type may be used, such as, for example, the type disclosed in Arnott U.S. Pat. No. 3,954,324.

The planar outer surface 26 of the end wall 20 makes an acute angle x with respect to the top wall 16. The angle x is equal to the angle w in the illustrated embodiment. Hence, the rib 22 has a lengthwise surface 23 that lies in a plane that is at a right angle to the plane of the outer end wall surface 26. This is an important factor in the manufacture of the housing components 12A and 12B. In order to mold each of the housing components 12A and 12B as a unit, the components must be removed from the mold in a direction normal to the surface 26. The direction normal to surface 26 is indicated by the arrow z (FIG. 3), since arrow z is normal to surface 26, it is parallel to ribs 22 and the lengthwise surfaces 23.

The pavement marker of FIGS. 1–4 further includes cylindrical studs 24 formed integrally on the inner surface 17. THe axis y of each cylindrical stud 24 makes an acute angle with the inner surface 17 that is equal to the acute angle w of the surface 23 of the ribbing. Each cylindrical stud 24 is disposed between a pair of the top wall ribs 22.

The embodiment of FIGS. 5–8 is identical to the embodiment of FIGS. 1–4 except for the addition of longer side wall ribs 130, and 132 and additional ribs 134.

In FIGS. 5–8, parts corresponding to parts identified in FIGS. 1–4 are identified by the same reference numerals except increased by 100, i.e., reference numerals 110, 112 112A, and 112B corresponding to reference numerals 10, 12, 12A and 12B of FIGS. 1–4, and so forth. The housing 112 has a top wall 116, sidewalls 118, and reflective wall 120. The ribbing includes four top wall ribs 122 corresponding to ribs 22 of FIGS. 1–4.

Figure 8:
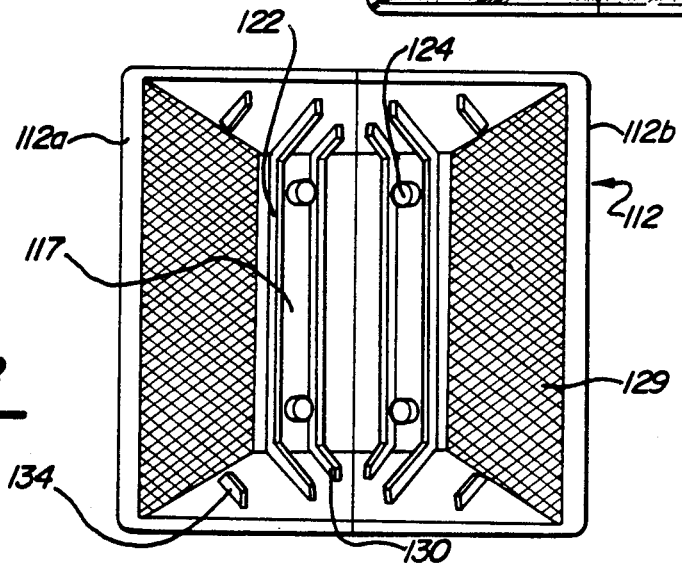
FIG. 8 is a bottom view of the housing of the pavement marker of FIG. 5.

Each rib 122 projects integrally from the inner surface of the top wall and extends lengthwise between the side walls 118. Each rib 122 has a lengthwise surface corresponding to the surface 23 of FIGS. 1–4, that makes an acute angle with respect to the inner surface 117 of the top wall (FIG. 8).

The embodiment of FIGS. 5–8 also includes cylindrical studs 124 that are identical to studs 24 of the FIGS. 1–4 embodiments.

The reflective end wall 120 has a planar outer surface 126 and an inner surface on which is formed reflective elements 129. The end wall ribs 130 and 132 are joined integrally to the ends of an associated top wall rib 122. The Ⓡnd wall rib 134 is formed on the triangular portion of the side wall 118, and is not associated with a top wall rib. Ribs 130, 132 and 134 make a right angle with surface 126 of their associated end walls 120.

The surfaces of the end wall ribs 130, 132 and 134 provide additional bonding surface for the potting material, and also have a wedging relationship with the inner surface 117 of the top wall. The right angle relationship of the ribs 130, 132 and 134 with the surfaces 126 makes it possible for the housing halves 112A and 112B to be molded as a unit.

Specific forms of the invention are illustrated in the drawings and described in the foregoing specification. The invention, however, is not limited to the exact construction shown. Alternative constructions within the scope of the claims will be apparent to those skilled in the art.

I claim:

1. A reflective pavement marker comprising:

a shell-like housing having a top wall, a pair of depending side walls, and a reflective end wall depending from one end of said top wall and extending transversely between said pair of side walls; and ribbing formed integrally on an inner surface of said top wall, said ribbing projecting from said inner surface of said top wall and having at least one lengthwise surface that makes an acute angle with respect to said inner surface of said top wall, said ribbing further having at least one side wall rib projecting from an inner surface of one of said pair of side walls.

2. A reflective pavement marker as claimed in claim 1 wherein said ribbing further includes a pair of spaced apart ribs that project from said inner surface of said top wall and extends lengthwise between said pair of side walls.

3. A reflective pavement marker as claimed in claim 2 wherein said pair of ribs are parallel to each other and extend transversely between and at right angles to said pair of side walls.

4. A reflective pavement marker as claimed in claim further including at least one cylindrical stud formed integrally on said inner surface of said top wall and having an axis making an acute angle with said inner surface of said top wall that is equal to the acute angle of said lengthwise surface of said ribbing.

5. A reflective pavement marker as claimed in claim 4 wherein said at least one cylindrical stud is disposed between said pair of ribs.

6. A reflective pavement marker as claimed in claim 5 wherein said at least one cylindrical stud comprises a pair of studs formed integrally on said inner surface of said top wall.

7. A reflective pavement marker as claimed in claim 1 wherein said inner surface of said top wall is substantially planar, and said at least one side wall rib extends lengthwise along said inner surface of said side wall at an acute angle with said top wall inner surface and parallel to said at least one lengthwise surface of said ribbing.

8. A reflective pavement marker as claimed in claim 1 wherein said housing is filled with potting material and said ribbing embedded in said potting material.

9. A reflective pavement marker as claimed in claim 1 wherein said reflective end wall has a substantially planar outer surface that makes a right angle with said at least one lengthwise surface of said ribbing.

10. A pavement marker housing component comprising an integral shell-like housing component including a top wall, a pair of side walls depending from opposite sides of said top wall along the full length thereof, each of said side walls having a triangular portion that projects beyond one end of said top wall and has an inclined edge that makes an acute angle with said top wall, a reflective end wall joined to said inclined edges of said side walls and an adjacent end of said top wall, said reflective end wall having a substantially planar outer surface and an inner surface formed with reflective elements, and ribbing formed integrally on an inner surface of said top wall, said ribbing projecting from said inner surface and having a lengthwise surface that makes an acute angle with respect to said inner surface and a right angle with respect to said outer surface of said end wall, said ribbing further including at least one side wall rib that projects from an inner surface of at least one of said pair of side walls.

* * * * *

UNITED STATES PATENT AND TRADEMARK OFFICE

CERTIFICATE OF CORRECTION

PATENT NO. : 5,002,424

DATED : March 26, 1991

INVENTOR(S) : Peter Hedgewick

It is certified that error appears in the above-identified patent and that said Letters Patent is hereby corrected as shown below:

Column 1, line 33, delete "parent" and insert --patent--.

Column 2, line 20, at the beginning of the line, after "nents", insert --.--.

Column 3, line 60, delete "Rnd" and insert --end--;

line 29, delete "THe" and insert --The--.

Column 4, Claim 4, line 1, after "claim", insert --2--.

Signed and Sealed this

Fifteenth Day of September, 1992

*Attest:*

DOUGLAS B. COMER

*Attesting Officer*

*Acting Commissioner of Patents and Trademarks*